US006808365B2

(12) United States Patent
Poon et al.

(10) Patent No.: US 6,808,365 B2
(45) Date of Patent: Oct. 26, 2004

(54) BLOWER MOTOR

(75) Inventors: Kwong Yip Poon, Hong Kong (CN); Siu Chun Tam, Hong Kong (CN)

(73) Assignee: Johnson Electric S.A., La Choux-de-Fonds (CH)

( * ) Notice: Subject to any disclaimer, the term of this patent is extended or adjusted under 35 U.S.C. 154(b) by 126 days.

(21) Appl. No.: 10/355,025

(22) Filed: Jan. 31, 2003

(65) Prior Publication Data

US 2003/0147746 A1 Aug. 7, 2003

(30) Foreign Application Priority Data

Feb. 7, 2002 (GB) ..... 0202839

(51) Int. Cl.[7] ..... F04B 17/00

(52) U.S. Cl. ..... 415/208.2; 415/214.1; 415/211.1

(58) Field of Search ..... 415/214.1, 170.1, 415/174.2, 208.2, 208.3, 208.4, 211.1, 211.2

(56) References Cited

U.S. PATENT DOCUMENTS

| | | | | |
|---|---|---|---|---|
| 4,057,370 A | * | 11/1977 | Numata et al. | 415/208.3 |
| 4,547,206 A | | 10/1985 | Sovis et al. | |
| 4,679,990 A | * | 7/1987 | Yamaura et al. | 415/208.2 |
| 4,767,285 A | | 8/1988 | Jyoraku et al. | |
| 5,110,266 A | * | 5/1992 | Toyoshima et al. | 415/119 |
| 6,309,180 B1 | * | 10/2001 | Gilliland et al. | 415/211.2 |

FOREIGN PATENT DOCUMENTS

EP 1 025 792 A2 8/2000

* cited by examiner

*Primary Examiner*—Edward K. Look
*Assistant Examiner*—Igor Kershteyn
(74) *Attorney, Agent, or Firm*—Birch, Stewart, Kolasch & Birch, LLP

(57) ABSTRACT

A bypass blower motor assembly having a motor section 10 and a blower section 11 separated by an end bracket 20 which has through openings. The openings are sealed by a diffuser plate 22 using a labyrinth seal and two O-rings 41, 42.

10 Claims, 4 Drawing Sheets

BLOWER MOTOR

FIELD OF THE INVENTION

This invention relates to blower motors and in particular, to a blower motor for use in a bypass or wet-type vacuum cleaner application.

BACKGROUND OF THE INVENTION

Blower motors in bypass vacuum cleaners have an impeller which moves air from an inlet to an outlet of an impeller housing fitted to the motor without passing through the motor itself. This construction allows the vacuum cleaner to suck up liquids as well as dust and dirt without damaging the electric motor.

The impeller is mounted on a shaft of the motor. The shaft is journalled in a bearing where it passes through an end bracket of the motor housing which also acts as a divider between the motor and the impeller. The bearing is sealed and an additional seal between the shaft and the end bracket may be provided to prevent air leakage from the impeller housing into the motor proper through the bearing. The fan end bracket separates the motor from the impeller housing and separates the motor from the working air flow of the impeller. One problem is that the fan end bracket has an axial extending annular projection to connect with the stator of the motor. A fan providing air flow for cooling the motor is mounted on the shaft adjacent the fan end bracket. This requires apertures in the annular projection to avoid the use of expensive side core moulding dies. These apertures are provided by axial holes which extend through the outer planar surface of the fan end bracket into the annular projection,. These holes in the end bracket need to be closed in order to seal the impeller chamber from the motor. This has been done conveniently by a diffuser plate. The diffuser plate provides guides for guiding the working air from the impeller to outlet openings in the impeller housing. The diffuser plate has a planar portion which lies over the fan end bracket and covers the openings in the end bracket. This has proved successful in low pressure blowers, but modern bypass blower motors run at a higher speed with more efficient impellers creating a higher pressure environment inside the impeller chamber adjacent the diffuser and end bracket. The high air pressure inside the impeller chamber causes leaking of air between the diffuser plate and the end bracket.

SUMMARY OF THE INVENTION

Accordingly, there is a need for an effective yet simple air tight seal between the end bracket and the diffuser plate. This is achieved by the present invention by the use of labyrinth seals, O-ring seals or a combination thereof between the end bracket and the diffuser plate.

Accordingly, the present invention provides a bypass blower motor assembly comprising: a motor including a shaft and a fan end bracket supporting a bearing for the shaft; a diffuser plate fitted to the fan end bracket; an impeller fixed to the shaft for rotation therewith; and an impeller housing fixed to the fan end bracket and accommodating the impeller and diffuser plate, wherein the impeller housing has an inlet and a plurality of outlet openings, the impeller being operated to create an air flow from the inlet to the outlet openings and the diffuser plate having vanes for guiding the air flow from the impeller to the outlet openings, the fan end bracket has a number of openings which are seated by the diffuser plate.

BRIEF DESCRIPTION OF THE DRAWINGS

A preferred embodiment of the present invention will now be described, by way of example only, with reference to the accompanying drawings, in which.

DETAILED DESCRIPTION OF THE INVENTION

Figure 1:
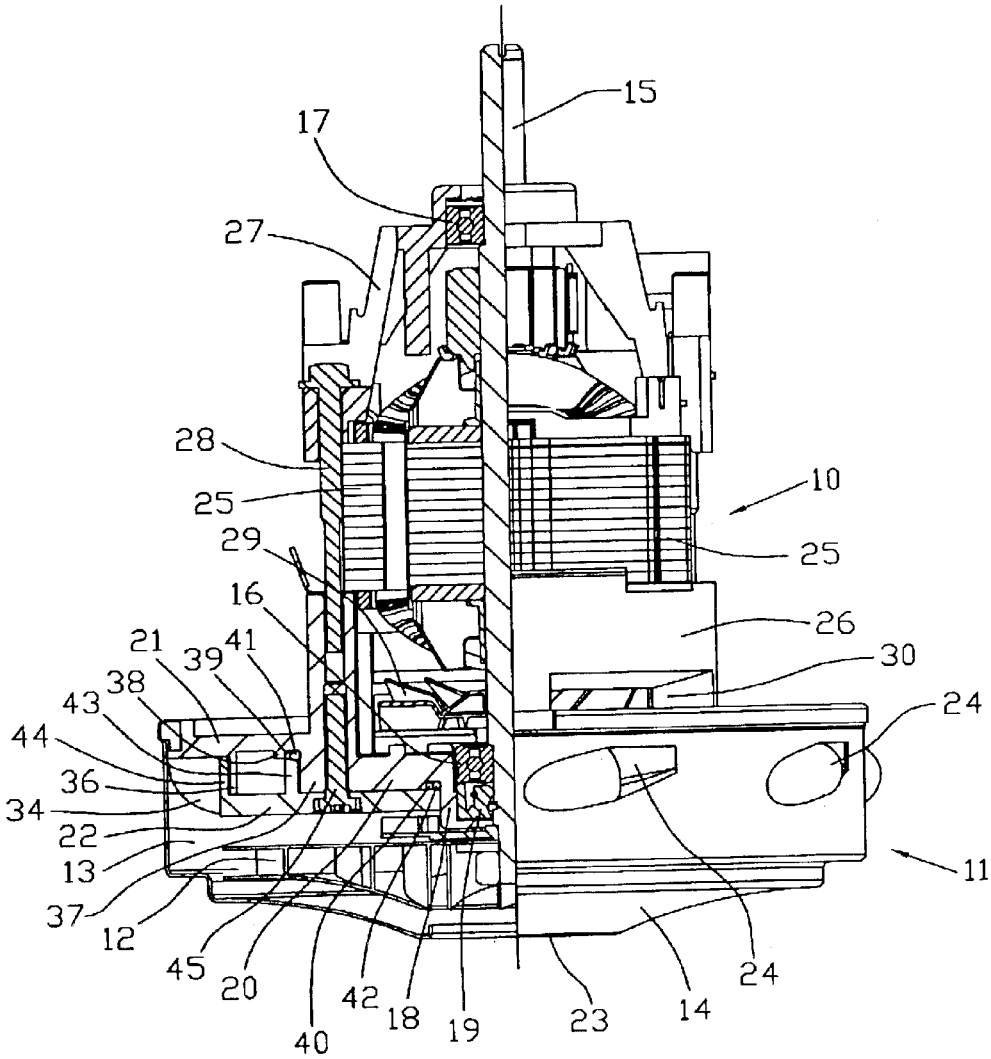
FIG. 1 is a part sectional view of a blower motor assembly incorporating an end bracket and diffuser plate arrangement according to the present invention.
Figure 2:
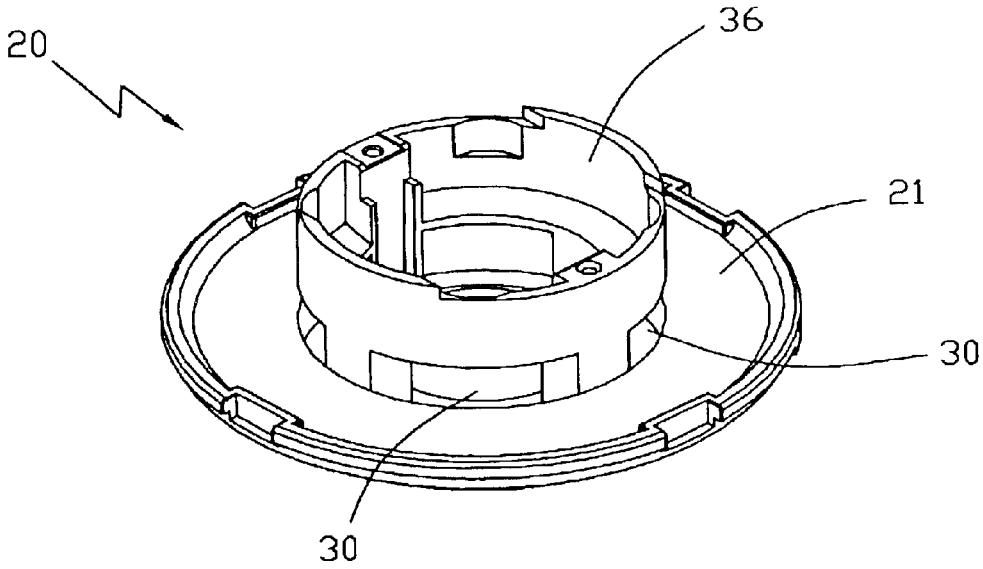
FIG. 2 is a perspective view from above of an end bracket as used in the assembly of FIG. 1.

A bypass blower motor assembly as used, for example, in a wet and dry vacuum cleaner is shown in partial section in FIG. 1. The motor assembly can be divided into a motor section and a blower section. The motor section comprises a universal motor 10. The blower section 11 comprises a high speed impeller 12 of the centrifugal fan type located within an impeller chamber 13 defined in part by an impeller housing 14.

As the universal motor and the blower are of known construction, details of their construction and operation will not be described in detail here except as required to explain the invention.

The motor 10 has a shaft 15 which is supported in bearings 16 and 17. Bearing 16, located adjacent the impeller chamber 13, is housed in a boss 18 formed in a fan end bracket 20. Oil seal 19 seals the shaft opening in the boss 18. Bracket 20 has a generally radially extending flange 21 to which the impeller housing 14 is secured. The impeller housing 14 has an inlet 23 in its lower surface and a plurality of louvered outlet openings 24 around its side. Rotation of the impeller 12 causes air to be drawn in through the inlet 23 and expelled through the outlets 24. A diffuser plate 22 has a plurality of vanes for directing the air from the impeller 12 to the outlet openings 24. The end bracket 20 is mounted directly to the stator core 25 of the motor 10 to accurately locate the bearing 16. The stator core 25 sits on an annular axial projection 26 of the bracket 20 and is clamped between bracket 20 and input end bracket 27 by bolts 28. The motor 10 has a fan 29 located next to bearing 16 for generating a flow of air for cooling the motor. The fan 29 draws air axially down over the motor and through the stator core 25 and then radially outwardly through windows 30 in the annular projection 26 of the end bracket 20.

Figure 3:
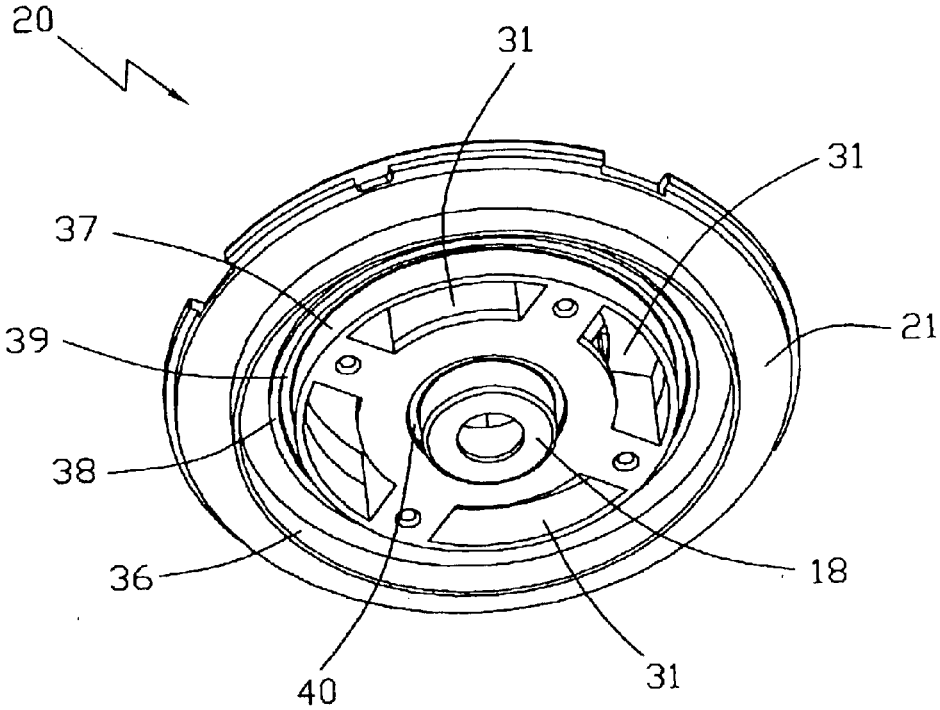
FIG. 3 is a perspective view from below of the end bracket of FIG. 2.

The fan end bracket 20 is an injection moulded part of thermosetting plastic material. The windows 30 in the annular projection 26 are formed by moulding axially extending apertures 31 in the lower face of the end bracket 20 as shown in FIG. 3. The diffuser plate 22 is disposed on the lower surface of the bracket 20. The diffuser plate 22 has a planar central portion 32 with a central opening 33 for locating the boss 18 of the end bracket 20. Around its periphery is a plurality of vanes 34 for directing the working air from the impeller upward to and outward through outlet openings 24 in the impeller housing 14. Each vane 34 has two guiding surfaces, one for guiding the air upward and another for guiding the air outwards.

Figure 6:
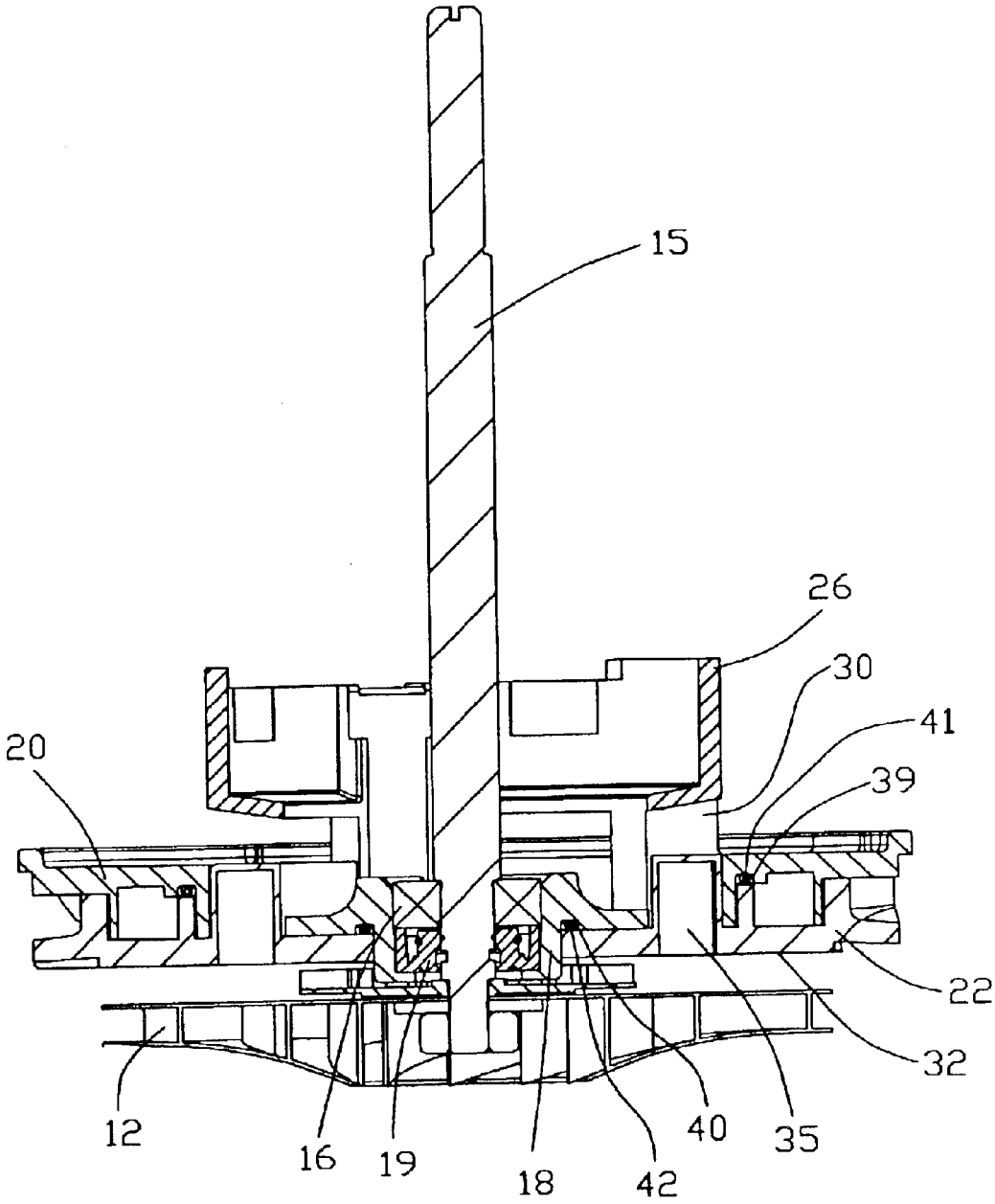
FIG. 6 is a schematic sectional view of a part of the assembly of FIG. 1 showing how the end bracket and the diffuser plate fit together.

The diffuser plate 22 also has a number of axial projections 35 which correspond in shape to the apertures 31 in the bracket 20 so that when fitted together as shown in FIG. 6, the projections 35 close the apertures 31 in the planar portion of the bracket 20 and do not extend into the annular projection 26 thus leaving open the windows 30 in the annular projection 26 for the passage of the cooling air. However, the projections 35 do not fully seal the apertures 31 against the high air pressure environment of the inside of the impeller chamber 13.

To seal the joint between the diffuser plate 22 and the end bracket 20, a labyrinth type seal arrangement is provided. Referring to FIG. 3 where the underside of the bracket 20 is shown, we can see that the underside of the bracket 20 has an outer annular wall 36 extending axially, an inner circular wall 37 just radially outward of the four openings 31 and a second annular wall 38 of lower height located just radially outside of the circular wall 37, thereby creating a groove 39 at the base of the circular wall. There is another groove 40 in the bracket 20 about the base of the boss 18 where it meets the lower surface of the bracket. O-ring seals 41, 42 are installed in the two grooves 39, 40 (shown in FIG. 1).

Figure 4:
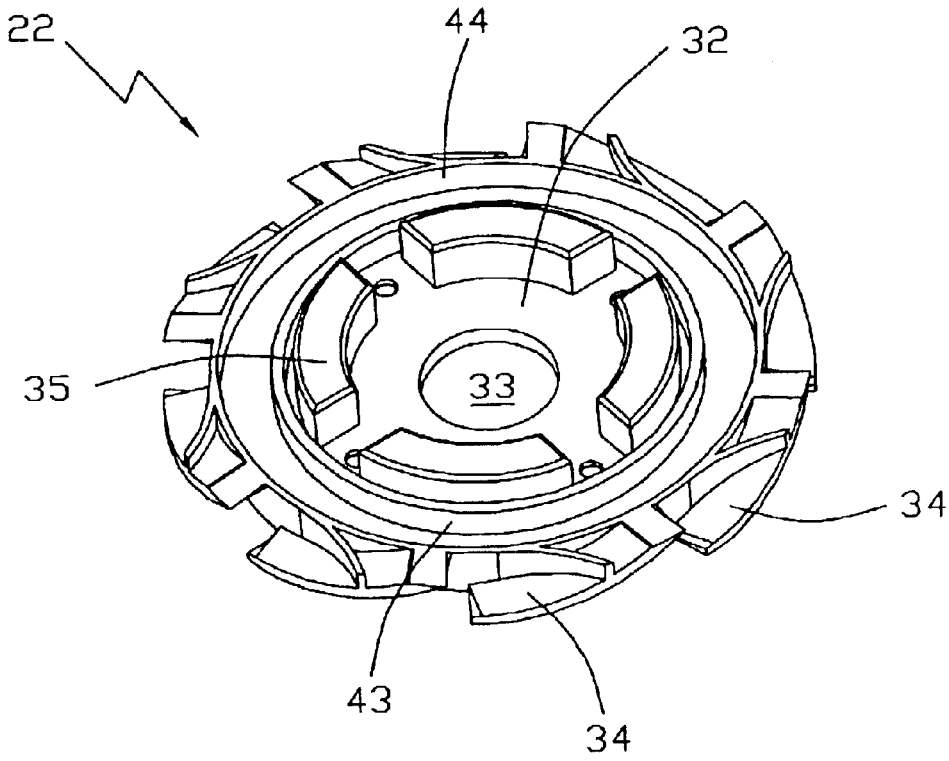
FIG. 4 is a perspective view from above of a diffuser plate as used in the assembly of FIG. 1.
Figure 5:
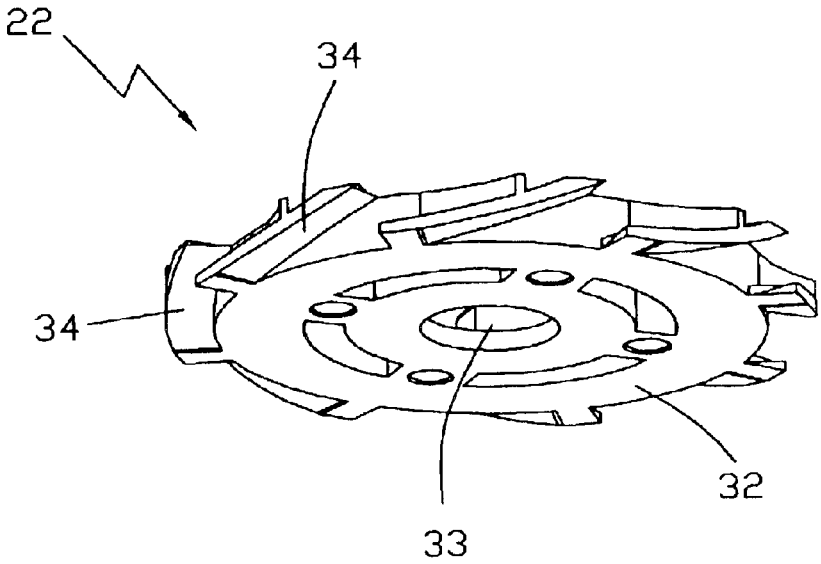
FIG. 5 is a perspective view from below of the diffuser plate of FIG. 4.

Turning now to FIG. 4, the upper surface of the diffuser plate 22 has an annular wall 43 enclosing the fan bracket projections 31 and a second radially outer wall 44 forming the periphery of the plate from which the vanes 34 extend. The walls 43, 44 mate with the walls 36, 37, 38 of the bracket 20 to form a labyrinth seal. Also the inner wall 43 of the diffuser plate 22 compresses the O-ring sea 41 in the outer groove 39 to perfect the outer seal. The inner seal is provided by the inner O-ring seal 42 being compressed by the diffuser plate 22 directly into the inner groove 40 in the bracket 20.

The labyrinth seal is designed to provide a flow path between the bracket 20 and the diffuser plate 22 which has such a high resistance that air does not flow. Should air flow, the path is too difficult for moisture and debris to be carried into the motor section. However, the O-ring seals 41, 42 provide additional sealing preventing leakage of air from the blower section 11 into the motor section 10 through the interface between the fan end bracket 20 and diffuser plate 22. The diffuser plate 22 is fixed to the end bracket 20 by four screws 45 which screw into the end bracket 20. Each screw 45 has a flanged head and an O-ring seal is nipped between the flanged head and the diffuser plate to prevent air leakage through the mounting screw holes (not shown).

The embodiment described above is given by way of example only and various modifications will be apparent to persons skilled in the art without departing from the scope of the invention as defined in the appended claims.

What is claimed is:

1. A bypass blower motor assembly comprises:

a motor including a shaft and a fan end bracket supporting a bearing for the shaft;

a diffuser plate fitted to the fan end bracket;

an impeller fixed to the shaft for rotation therewith; and an impeller housing fixed to the fan end bracket and accommodating the impeller and diffuser plate, wherein the impeller housing has an inlet and a plurality of outlet openings, the impeller being operable to create an air flow from the inlet to the outlet openings and the diffuser plate having vanes for guiding the air flow from the impeller to the outlet openings, and the fan end bracket has a number of openings which are sealed by the diffuser plate.

2. The assembly of claim 1 wherein the end bracket and the diffuser plate provide a labyrinth seal arrangement to seal the openings in the end bracket.

3. The assembly of claim 1 wherein at least one O-ring seal is nipped between the end bracket and the diffuser plate to seal the openings in the end bracket.

4. The assembly of claim 3 wherein the O-ring is pressed into a groove in the end bracket or the diffuser plate by a projection formed on the other of the diffuser plate or end bracket as appropriate.

5. The assembly of claim 4 wherein one of the O-ring seals is located radially outward of the openings and the other one of the O-ring seals is located radially inward of the openings.

6. The assembly of claim 5 wherein the inner O-ring seal is located in a groove adjacent to a bearing boss formed in the end bracket.

7. The assembly of claim 6 wherein the diffuser plate is fixed to the end bracket by screws and the head of each screw is sealed to the diffuser plate.

8. The assembly of claim 7 wherein the head of each screw is sealed to the diffuser plate by an O-ring seal.

9. The assembly of claim 1 wherein two O-ring seals located in respective grooves in the end bracket or diffuser plate are pressed into the grooves by the diffuser plate or end bracket as appropriate to seal the openings.

10. The assembly of claim 1 wherein the diffuser plate is fixed to the end bracket by screws and the head of each screw is sealed to the diffuser plate.

* * * * *